US007467768B1

(12) United States Patent
Vait

(10) Patent No.: US 7,467,768 B1
(45) Date of Patent: Dec. 23, 2008

(54) TRUCKER'S TRASH CAN

(76) Inventor: Tom J. Vait, 205 Teakwood La., Lewisville, TX (US) 75067

( * ) Notice: Subject to any disclaimer, the term of this patent is extended or adjusted under 35 U.S.C. 154(b) by 0 days.

(21) Appl. No.: 11/750,753

(22) Filed: May 18, 2007

(51) Int. Cl.
*A47F 5/12* (2006.01)

(52) U.S. Cl. ..... 248/133; 248/907; 248/127; 220/908; 220/475; 220/23.2; 220/631; 211/85.18; 211/85.19; 211/85.21; 211/85.22; 211/71.01

(58) Field of Classification Search ..... 248/907, 248/127, 133; 220/908, 475, 23.2, 23.4, 220/23.86, 631, 628; 211/85.19, 85.21, 85.22, 211/71.01, 85.18
See application file for complete search history.

(56) References Cited

U.S. PATENT DOCUMENTS 2,043,896 A * 6/1936 Larsen et al. ..... 248/132
2,466,288 A * 4/1949 Waterman ..... 248/312.1
2,614,700 A * 10/1952 Kjeldsen ..... 211/75
2,701,700 A * 2/1955 Williamson ..... 248/146
2,838,264 A * 6/1958 Hill ..... 248/147
3,080,978 A * 3/1963 Gress ..... 211/85.19
3,167,205 A * 1/1965 Smith ..... 248/133
3,235,212 A * 2/1966 Baumiller, Jr. ..... 248/142
3,240,459 A * 3/1966 Spohn, Jr. ..... 248/146
3,279,732 A * 10/1966 Paul ..... 248/146
3,288,306 A * 11/1966 Walters ..... 211/85.19
3,515,285 A * 6/1970 Wilkes ..... 211/85.19
3,561,606 A * 2/1971 Stewart ..... 211/84
3,625,370 A * 12/1971 Mintz ..... 211/85.19
3,666,223 A * 5/1972 Moore ..... 248/149
3,675,940 A 7/1972 Crookston
3,788,584 A 1/1974 Deike
4,191,297 A * 3/1980 Hardman ..... 211/83
4,193,161 A 3/1980 Scott
4,300,696 A * 11/1981 Bryce ..... 248/133
4,527,695 A * 7/1985 Arms ..... 211/85.19
4,984,704 A 1/1991 O'Malley
5,067,626 A * 11/1991 Leumi ..... 220/475
5,213,294 A * 5/1993 DeBord ..... 248/147
D384,462 S 9/1997 Fox et al.
5,860,659 A 1/1999 Hart
6,715,647 B1 * 4/2004 Ivins ..... 222/166

* cited by examiner

*Primary Examiner*—J. Allen Shriver, II
*Assistant Examiner*—Michael McDuffie
(74) *Attorney, Agent, or Firm*—Lawrence J. Gibney, Jr.

(57) ABSTRACT

In order for a truck driver to be able to empty the contents of the cab of his vehicle a set of trash cans, which are mounted to a structure is provided. The structure will be mounted at a certain height so that the truck driver will not need stop his truck in order to use this device.

1 Claim, 4 Drawing Sheets

TRUCKER'S TRASH CAN

BACKGROUND OF THE INVENTION

1. Field of the Invention

This relates to discarding items from a truck without the necessity of exiting the truck.

2. Prior Art

There are many other prior art references to trash cans and elevated trash containers. A representative example of this type can found at Hart, U.S. Pat. No. 5,860,659, which is a carrier for holding and transporting containers, including trash containers. However, the containers are not elevated in that particular application. An application wherein some containers are elevated can be found at O'Malley, U.S. Pat. No. 4,984,704. The different trash receptacles are elevated. However, in order to empty a receptacle, each receptacle must be individually unloaded.

Other examples in the prior art include Crookxton, U.S. Pat. No. 3,675,946, and Blanchard, U.S. Pat. No. 2,952,434. Blanchard is a tiltable garbage can assembly, which is similar but different in several important respects to the current application.

BRIEF SUMMARY OF THE INVENTION

For truck drivers in particular, it is necessary to unload the trash or debris from the cab of the truck. An easy method to do this without interfering with the operation of the truck and without requiring the truck driver to exit his truck can be found in the current application. This is a tiltable garbage can assembly, which is secured to a base at one end and two 55-gallon drums at the other. The 55-gallon drums are secure to a U-framed structure and handles are provided to enable someone on the ground to remove the can for the purpose of emptying its contents.

A stop mechanism is provided so that the 55-gallon drums do not tilt over inadvertently and spill the contents of the 55-gallon drums. Additionally, there is a counterweight so that, once tilted, the trash cans will return to their normal position. When is use the drums will be slightly angled for ease of use.

It is an object of this device to construct a device wherein a truck driver unloads debris from his rig without the necessity to exit the vehicle.

DRAWING REFERENCE NUMBERS

Figure 1:
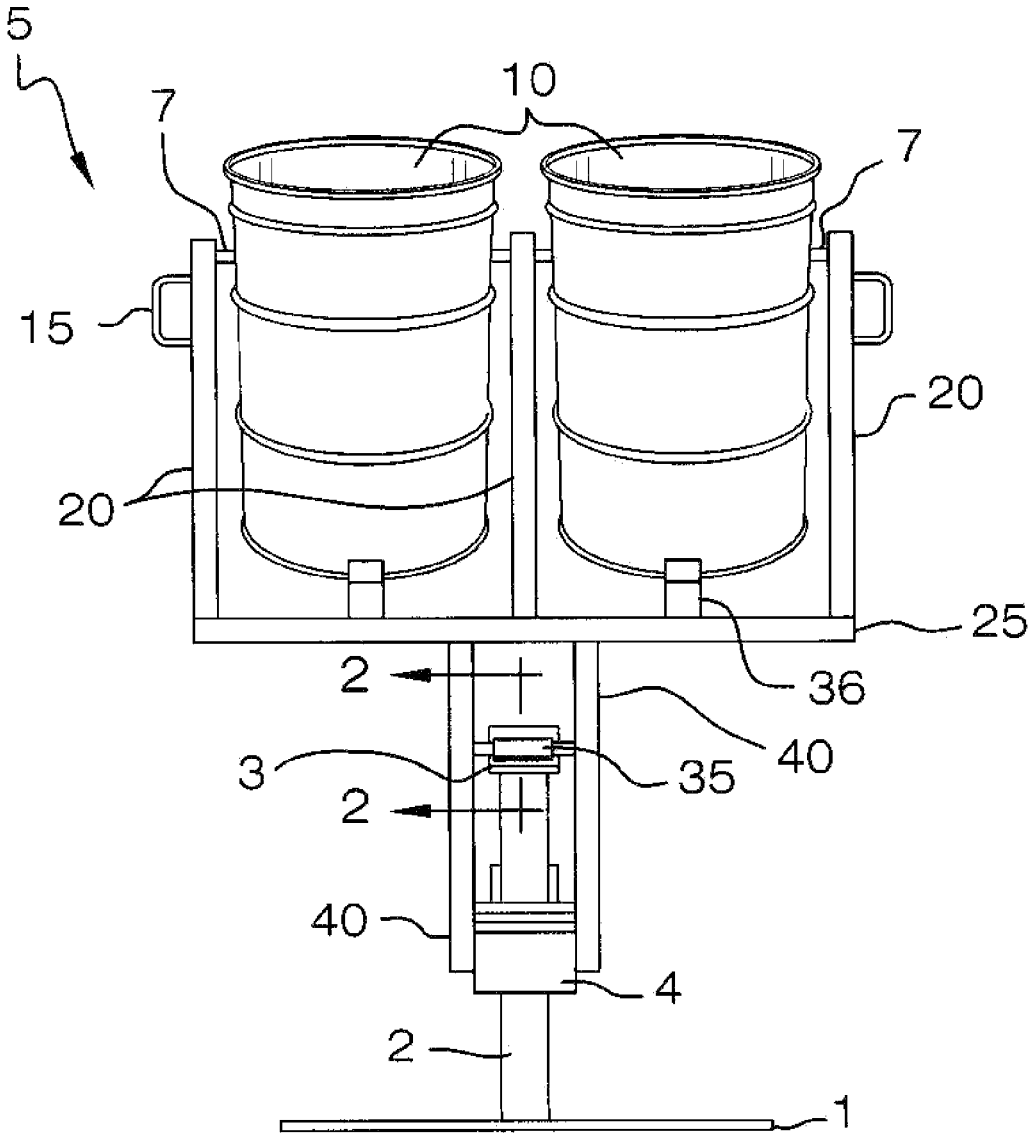
FIG. 1 is a front view of the device.
Figure 2:
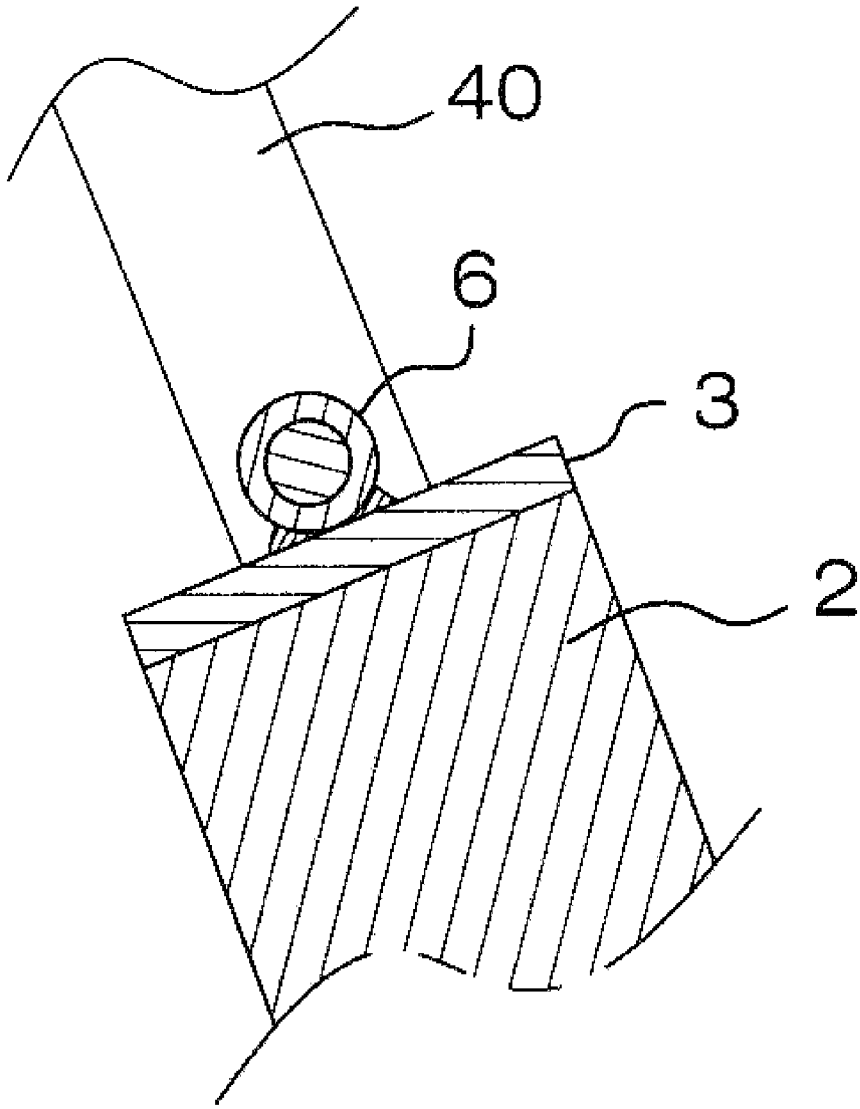
FIG. 2 is a view according to line 2-2 on FIG. 1.

For purposes of the Figures the following numbering references will be used:

1 Base
2 Main column
3 Plate
4 Counterweight
5 Device
6 Flat hinge
7 Upper horizontal bar
8 Truck
9 Trash bag
10 55-gallon drum

11 Trash
15 Handle
20 Vertical support bars
25 Lower horizontal bar
35 Pivot pipe
36 Drum stopper
40 Pivot bars

DETAILED DESCRIPTION OF THE EMBODIMENTS

Figure 4:
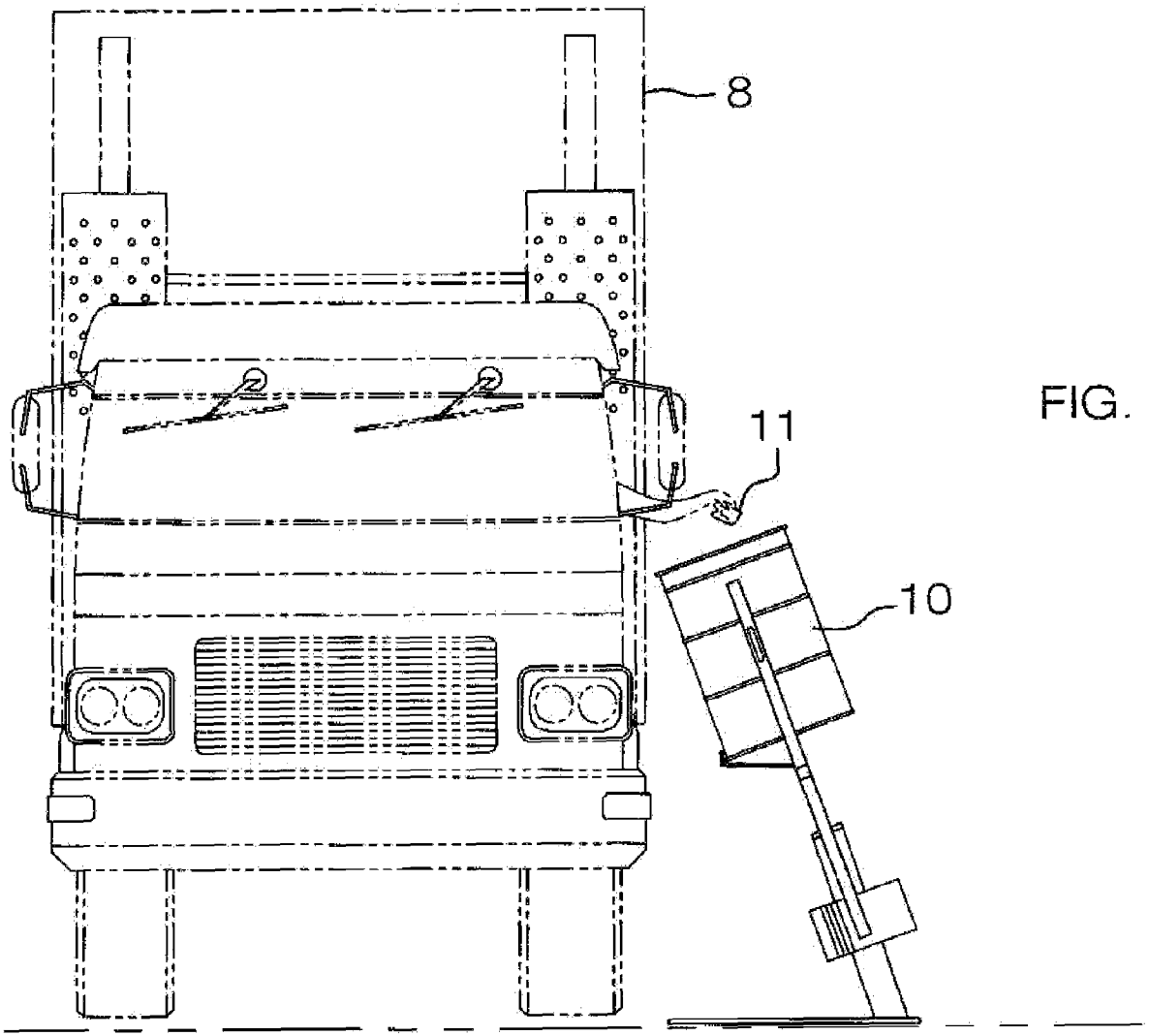
FIG. 4 is a side view of the device in use.

When a truck driver exists the truck, the truck driver is affected by the loss of time. Truck driver typically collect trash in their cab much the same way that people who drive automobiles collect or accumulate trash in their front seat. Unfortunately because of the length of time that a truck driver is in the cab of his truck, trash will generally accumulate at a much greater rate. Additionally because time is money for a truck driver, it is important to be able to allow the truck driver to be able to empty his cab without needing to stop his truck and get out to empty the trash in the cab of the truck. This is a device by which a truck driver can easily empty the contents of the truck cab without exiting the cab such as depicted in FIG. 4.

The device itself will rest on a base 1. The base should be sturdy enough to support the weight of the device. Secured to the base will be a main column 2 that will be angled for ease of use and position. The specific angle must be such that the device will rest in place but not tilt over and empty the contents of a pair of 55-gallon drums 10 that are secured to the top structure of the device.

Figure 3:
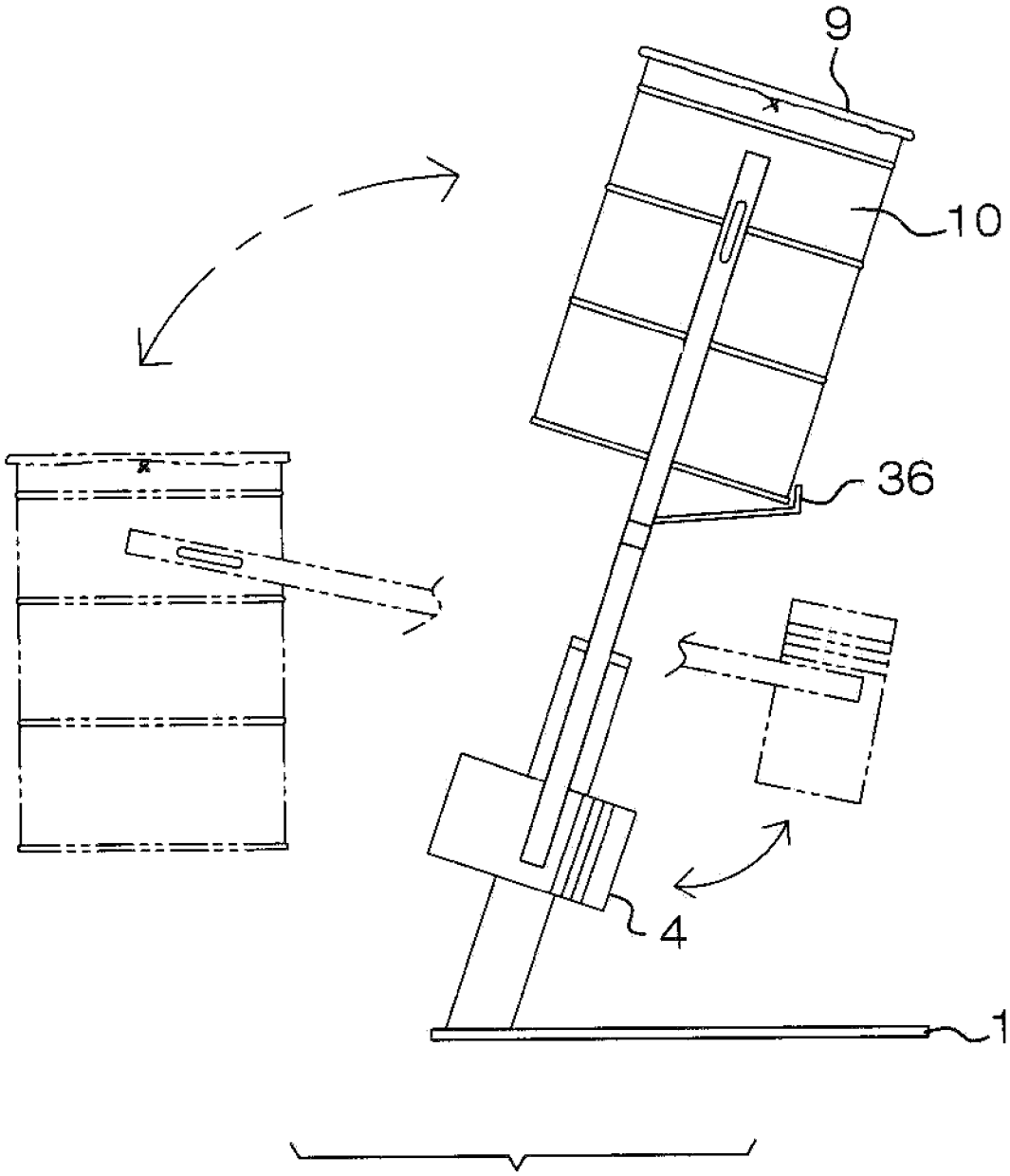
FIG. 3 is a side view of the device.

The main support column 2 ends with a plate 3. The plate secures a pipe hinge 6 and a pivot pipe 35. The pivot pipe 35 is inserted into the opening of the pipe hinge on the top plate 3 and the ends of the pivot pipe are secured to the sides of a set of pivot bars 40. The pivot pipe 35 allows the top portion of the structure to rotate as depicted in FIG. 3 and then return to its normal position because a counterweight 4 will force the device to returned to its normal position.

On the top and secured to one end of the pivot bars 40 will be a lower horizontal bar 25. The lower horizontal bar 25 will extend a predetermined distance and will allow a pair of trash cans, such as fifty-five gallon drums 10 to be installed in the structure of this device. A trash bag 9 may be inserted into the drum 10.

A set of vertical support bars 20, which extend vertically from the ends of the lower horizontal bar, will complete the structure into which the fifty-five gallon drums will be inserted. The lower horizontal bar 25 and vertical bars 20 form the structure into which the trash can will rest. An upper horizontal bar 7 will be secured to the vertical support bars and will complete the frame structure. Handles 15 are provided on one side of the vertical bars to enable the cans to be rotated downward to empty the contents of the can.

Within the space provided and formed by the vertical and lower and upper horizontal bars will be two 55-gallon drums 10. The 55-gallon drums will rest on the lower horizontal bar 25, upper horizontal bar 7 and the vertical support bars 20. A drum stopper 36 is secured to the horizontal member probably by welding and will allow the trash can to rest secured to the device but prevent the contents of the 55-gallon drums to be emptied inadvertently.

In use, the truck 8 will simply pull up to the device and unload the trash 11 as depicted in FIG. 4. This enables the truck driver to unload his trash without needing to stop his truck and lose valuable time and money.

The invention claimed is:

1. A device to collect trash, which is comprised of:

a base;

wherein the base is secured to the ground;

a main column;

wherein the main column is secured to the base;

wherein the main column is angled slightly relative to the base;

wherein the main column has a first end and a second end;

wherein the first end of the main column is secured to the base;

wherein the second end of the main column is a top plate;

said top plate secures a pipe hinge;

wherein a pivot pipe is in the interior of the pipe hinge;

wherein the ends of the pivot pipe are secured to a plurality of pivot bars;

wherein the pivot bars support the weight of the device;

wherein the pivot bars have a first end and a second end;

wherein the first end of the pivot bars is secured to a counterweight;

wherein the second end of the pivot bars is secured to a lower horizontal bar;

wherein the horizontal bar has a plurality of secured vertical bars;

a plurality of 55-gallon drums;

wherein the vertical bars support the 55-gallon drums;

a handle;

wherein a plurality of handles is provided on one edge of the vertical bar;

wherein a stopper is provided and secured to the horizontal bar.

* * * * *